United States Patent [19]

Licht

[11] 3,955,869

[45] May 11, 1976

[54] ELECTRICAL SOCKET AND SOCKET CONTACT ADAPTED FOR USE THEREWITH

[75] Inventor: Harry Licht, Neckarsulm, Germany

[73] Assignee: Bunker Ramo Corporation, Oak Brook, Ill.

[22] Filed: Aug. 2, 1974

[21] Appl. No.: 494,208

Related U.S. Application Data

[63] Continuation of Ser. No. 336,929, March 1, 1973, abandoned.

[52] U.S. Cl. ..... 339/32 R; 339/258 P

[51] Int. Cl.[2] ..... H01R 27/00; H01R 11/22

[58] Field of Search ..... 339/32, 17 LC, 192 R, 339/198 S, 205, 256, 258, 259, 262

[56] References Cited

UNITED STATES PATENTS

| | | | |
|---|---|---|---|
| 2,085,707 | 6/1937 | Shore | 339/258 RR |
| 2,342,711 | 2/1944 | Wade | 339/205 |
| 2,463,826 | 3/1949 | Thacker | 339/258 R UX |
| 3,162,501 | 12/1964 | Wahl | 339/98 |
| 3,208,027 | 9/1965 | Johnson | 339/258 X |
| 3,245,024 | 4/1966 | Evans | 339/258 P X |
| 3,346,834 | 10/1967 | Kinkaid | 339/198 S X |
| 3,358,266 | 12/1967 | Chandler et al. | 339/205 |
| 3,383,638 | 5/1968 | Coldren | 339/258 F X |
| 3,439,316 | 4/1969 | Evans | 339/192 R UX |
| 3,701,967 | 10/1972 | Kreutter | 339/256 R X |

FOREIGN PATENTS OR APPLICATIONS

| | | | |
|---|---|---|---|
| 1,183,576 | 12/1964 | Germany | 339/258 F |

*Primary Examiner*—Roy D. Frazier
*Assistant Examiner*—Lawrence J. Staab
*Attorney, Agent, or Firm*—D. R. Bair; F. M. Arbuckle

[57] ABSTRACT

This invention relates to an electrical socket and to a socket contact which is adapted for use therewith. The contact has two pairs of symmetrically positioned contacts, with the contacts of each pair being angled in an opposite direction. Thus, a male element may be inserted in the socket from either end without causing any change in the electrical characteristics of the socket. Further, the arrangement of the socket contacts permits the maintaining of good electrical contact with a male conductor element under adverse conditions of shock and vibration.

3 Claims, 6 Drawing Figures

Fig. 5.
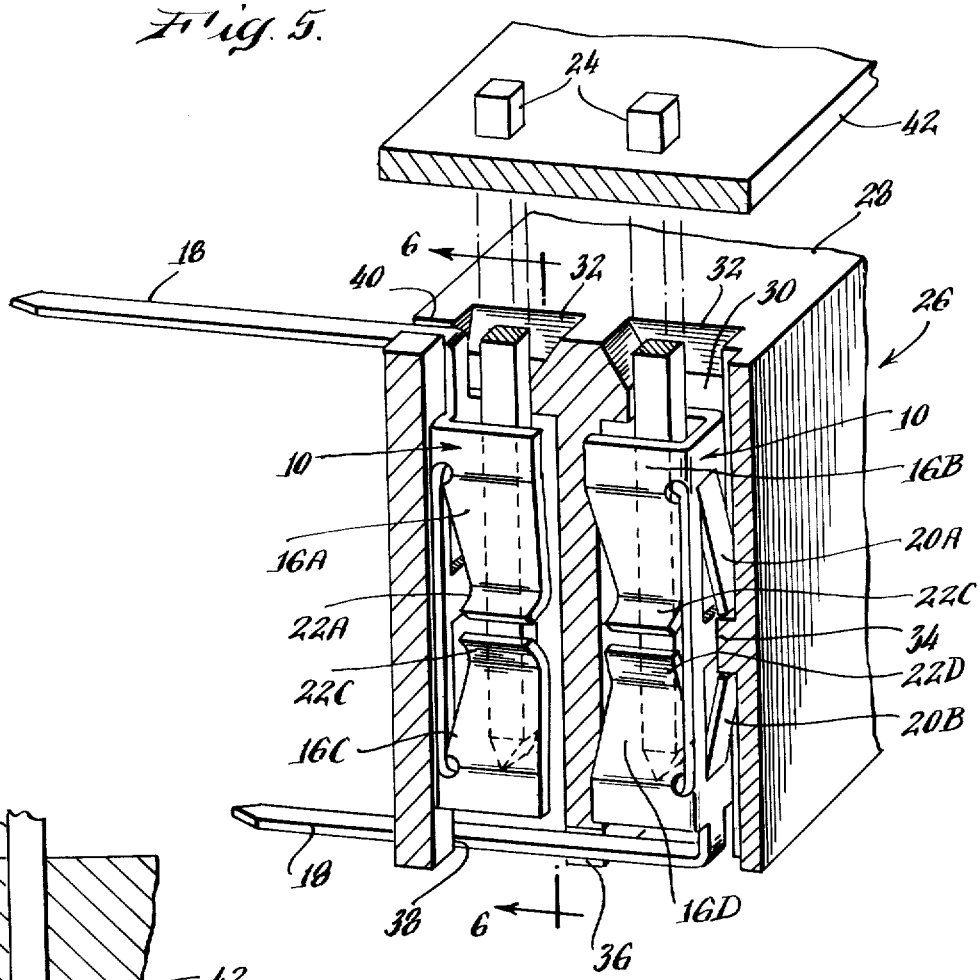
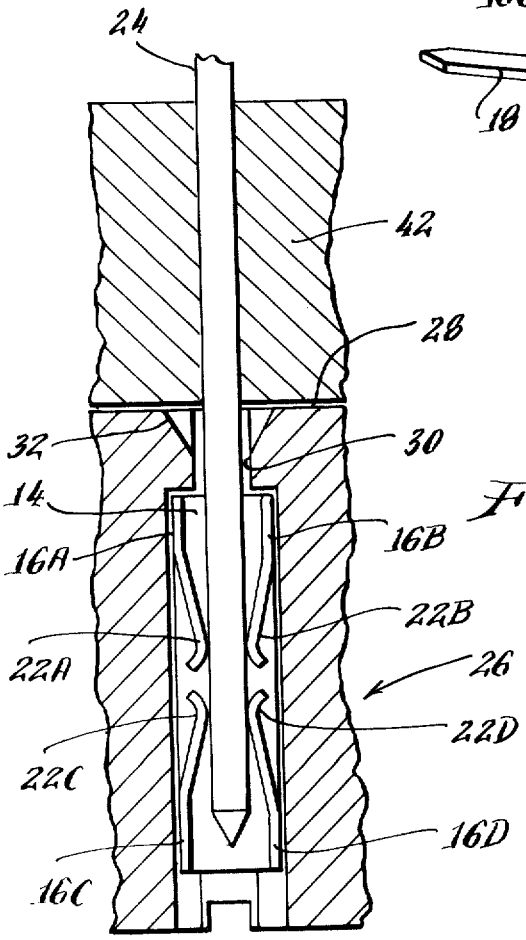
Fig. 6.

ELECTRICAL SOCKET AND SOCKET CONTACT ADAPTED FOR USE THEREWITH

This is a continuation of application Ser. No. 336,929, filed Mar. 1, 1973, now abandoned.

This invention relates to an electrical socket and to a socket contact for use therewith which contact is adapted to receive a pin or other conductive element from either of two ends without any change in contact characteristics.

BACKGROUND OF THE INVENTION

In the various applications in which electrical sockets and socket contacts are utilized, there are occasions where a requirement exists to be able to insert a pin, spade, or other conductive element into a socket contact from either end of the contact without any noticeable change in electrical characteristics. Heretofore, socket contacts, particularly ones utilizing spring arms as the contacting elements, have either not been adapted for insertion of the male conductor element from either end of the socket or, because of the non-symmetry of the design, have evidenced noticeable, and sometimes significant, differences in electrical characteristics depending on the end of the contact in which the male element is inserted. A need therefore exists for a simple and inexpensive socket contact in which a male element may be inserted from either end without any noticeable difference in socket electrical characteristics.

Another problem with many existing socket contacts is that they provide only a simple pair of contact points, and even where two or more contact points are provided on each side of the contact, these contact points are formed from or mounted on a common arm. The provision of only two independently mounted contact points, normally extending in the same direction, renders the contact subject to momentary or permanent electrical discontinuities due to shock or vibration or to deformation of a contact arm during insertion or removal of a male conductor element. Additional contact points on a simple cantilever-mounted arm tends to increase the length of the arm and thus the likelihood of its being shaken or bent out of electrical contact with the male element. Thus, the provision of additional contact points on a contact arm tends to aggravate rather than alleviate the problem of maintaining good electrical contact under adverse conditions. A need therefore also exists for a simple and inexpensive socket contact which is capable of maintaining good electrical contact with a male conductor element inserted therein under adverse shock and vibration conditions and to be highly resistant to permanent deformation of the contact arms during male element insertion and removal.

SUMMARY OF THE INVENTION

In accordance with the above, this invention provides an electrical socket utilizing a socket contact which is adapted for receiving a conductive element from either of two ends. The contact has a base and first and second pairs of contact arms. The contact arms are symmetrically positioned on the base with the arms of the first pair being attached at one end to one end of the base and the arms of the second pair being attached at one end to the other end of the base. Each arm is bent to project at an angle toward the center of the contact, the arms of each pair forming a funnel-shaped conductive element receiving opening. A conductive element receiving opening is thus provided at each end of the contact, permitting element insertion from either end. Each arm has a contact point near its free end. The contact point for the arms of each pair are aligned with each other and those for the corresponding arms of the other pair. Thus, all four contact points engage a conductive element inserted into the contact regardless of the end of the contact from which the element is inserted. Finally, the contact has a portion, such as an elongated tail, which is adapted to have an electrical conductor connected thereto.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 5 is a partial sectional view of a socket of this invention utilizing a socket contact of the type shown in FIG. 1.

FIG. 6 is a sectional view taken along the line 6-6 of FIG. 5.

DETAILED DESCRIPTION

Figure 4:
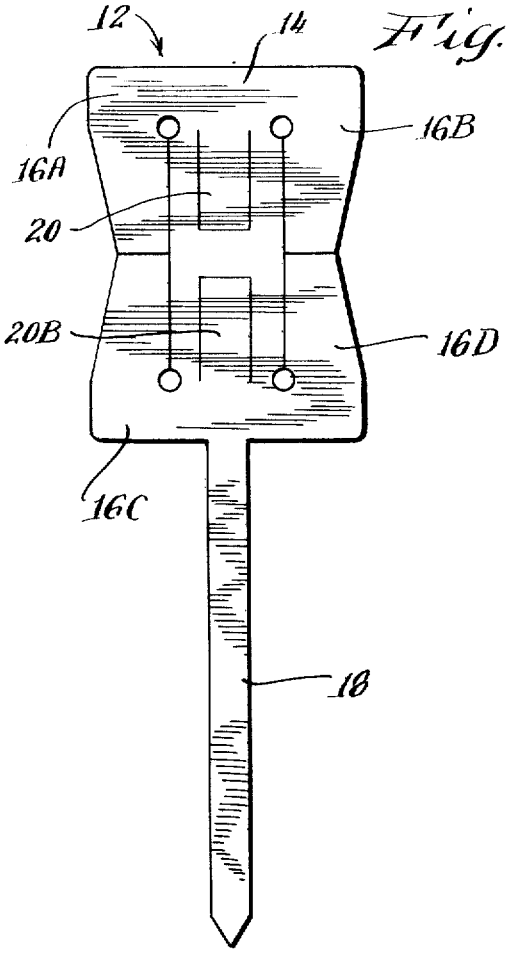
FIG. 4 is a front view of the blank utilized in forming the socket contact shown in FIG. 1.

Referring now to FIGS. 1-4, it is seen that the socket contact of this invention is formed from a single blank stamped from a sheet of a conductive or metallic material. Because portions of the contact are required to act as spring elements, the material utilized for the contact should have good flexural strength and a high elongation factor. A copper-alloy is an example of a material suitable for use for socket contact 10. The stamped blank 12 utilized in forming contact 10 is shown in FIG. 4.

Contact 10 consists of a generally planar rectangular base 14, an upper pair of arms 16A and 16B, a lower pair of arms 16C and 16D, an elongated tail 18 extending from base 14, and a pair of locking tabs 20A and 20B projecting from the rear of base 14. Each of the arms 16 is bent at a right angle or transverse to the general plane of base 14 and extends from the front thereof with arms 16A and 16B being integrally formed or attached at one end to the upper sides or adjacent one end of a respective opposite edge 14A and 14B of base 14 and arms 16C and 16D being attached at one end to the lower sides or adjacent the opposite end of a respective opposite edge 14A and 14B of base 14. The portions of arms 16A and 16B which are attached to base 14 are substantially parallel to each other as are the portions of arms 16C and 16D which are attached to the base. The longitudinally extending free cantilever portion of each arm 16A, 16B, 16C and 16D which is not attached to base 14 is bent at an angle toward the center of the base or a vertical plane intermediate the ends of the opposite edges of base 14 on which the arms are formed and perpendicular to the horizontal plane defining the juncture of edges 14A and 14B with the upper surface of the base to a contact point 22A, 22B, 22C and 22D at which point the free end of the contact arm is bent back at an angle A.

Figure 1:
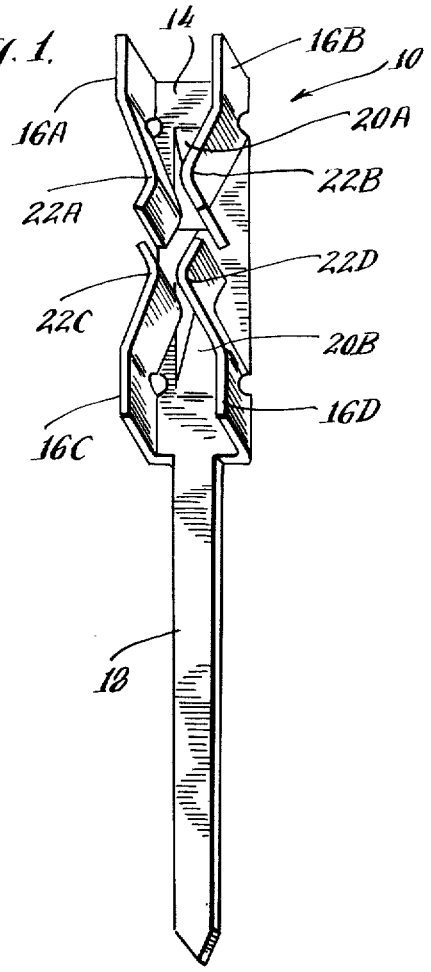
FIG. 1 is a perspective view of a socket contact of a preferred embodiment of the invention.
Figure 2:
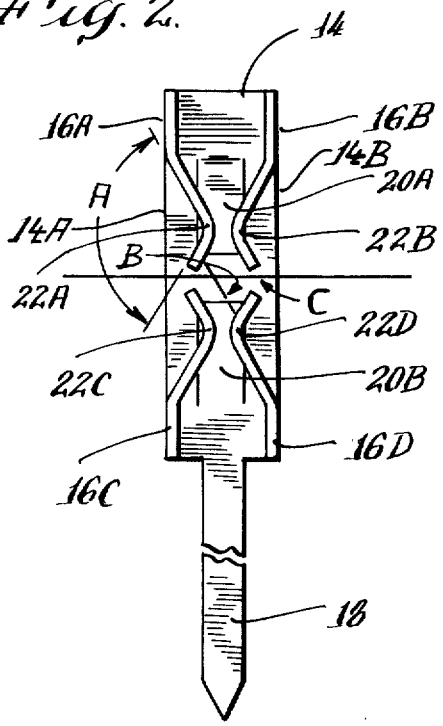
FIG. 2 is a front view of the socket contact shown in FIG. 1.
Figure 3:
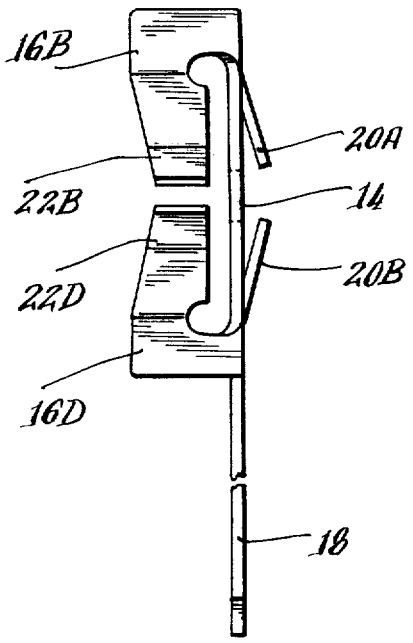
FIG. 3 is a side view of the socket contact shown in FIG. 1.

As may be best seen in FIGS. 1 and 2, this results in four independently supported contact points 22A, 22B, 22C, and 22D which contact points are symmetrically mounted and positioned near the center of the socket contact to form yieldable passageways for a male or pin contact inserted from either of two directions coincident or extending along the elongate axis of the pin contact. As may be best seen in FIGS. 5 and 6, the symmetrical positioning of the contact points 22A, 22B, 22C and 22D results in identical contact engagement with a pin 24 inserted in the contact regardless of whether the pin is inserted from the top or bottom of the socket. Further, the cantilever arms for each of the contact points is relatively short providing high resistance to contact bounce or other movement as a result of shock or vibration. As is obvious from FIGS. 1, 2, 3, 5, and 6 of the drawings, the arms 16A, 16B, 16C and 16D are overlapped by the base and project from one side transverse to the generally planar rectangular base 14. Each arm is integrally formed with the base adjacent one end of the arm and adjacent a respective one or other end of the respective base elongate edges to provide a supporting portion for each arm. Each supporting portion has a free cantilever portion extending therefrom at an acute angle as indicated at B in FIG. 2 toward a plane located intermediate opposite ends of the edges on which the arms are formed and perpendicular to the plane in which the edges lie. The cantilever portions of each pair of arms also extend toward each other and each has a free end portion extending from the free end portion of the other arm of the pair and at an acute angle indicated at C in FIG. 2 toward the intermediate plane. With this arrangement, as best seen in FIGS. 5 and 6, the cantilever portions and free ends of one pair of arms 16A and 16B form respective yieldable contact engaging surfaces for engaging and supporting a pin contact 24 at one respective position spaced axially along the elongate axis of the pin contact and the cantilever portions and free ends of the other pair of arms form respective yieldable contact engaging surfaces and supporting surfaces for the pin contact at another respective position spaced axially along the elongate axis of the pin contact and each pair of cantilever portions and free ends form yieldable guideways for receiving the pin contact in a direction coincident with the axis of the pin contact. The contact-supporting arms 16 being angled in opposite directions normally means that any force on the contact which would tend to move one of the contact points 22A, 22B, 22C or 22D away from a pin 24 would tend to move a corresponding contact point 22A, 22B, 22C or 22D on another arm against the pin. This provides further protection against electrical discontinuities under conditions of shock and vibration. A simple, inexpensive, highly reliable socket contact is thus provided which contact is adapted for receiving pins or other male conductor elements from either end.

Tail 18 is adapted to be fitted into a printed circuit board or like element or to be directly connected to. The tail is provided with sharp corners so that electrical connection may be made with it by soldering or other standard techniques.

Referring now to FIGS. 5 and 6, a socket 26 is shown utilizing the contacts 10. Socket 26 consists of a housing 28 having two or more cavities 30 formed therein in which contacts 10 may be mounted. Each cavity 30 has at one end a pin-receiving opening 32 which opening has tapered walls for guiding a pin during insertion. Openings 32 assure proper orientation of a pin 24 during insertion and removal, thus minimizing the danger of arm deformation or other damage to a socket contact during pin insertion and removal. Each cavity 30 also has a ridge 34 formed at about the midpoint of its outer wall.

As may be best seen in FIG. 5, the right-hand one of the contacts 10 is inserted from the bottom into the corresponding cavity 30 upper and first, while the left-hand contact 10 is inserted into its cavity lower end first. Each of the contacts is forced up into its corresponding cavity until the upper of its tabs 20 (tab 20A for the right-hand contact and tab 20B for the left-hand contact) clears ridge 34 at which time the leading edge of each lower tab engages ridge 34 preventing the contact from being inserted further. The leading edge of the upper tab coacts with ridge 34 to prevent the contact from being removed. Should it be desired later to remove the contact from its cavity, a pry tool is inserted into cavity 30 through opening 32 to cam the upper tab 20 (for example 20A) against the contact 10, permitting it to clear ridge 34 so that the contact may be removed. Tail 18 for the lower contact is bent to the left through a ridge 36 formed in the center of housing 28 and a ridge 38 in the left wall of the housing while the tail 18 for the left-hand contact 10 is bent to the left through a ridge 40 formed in the left wall of housing 28. The projecting tails 18 may be mounted in a circuit board or electrically attached to in any of a variety of manners previously indicated.

It will be noted that the contact receiving passageways or cavities 30 for receiving the contacts extend to opposite ends of the housing 28 with the wall or ridge 34 formed intermediate the opposite contact receiving passageway ends having surfaces transverse to the elongate axis of the passageway for engaging spaced free ends of the cantilever tines or tabs 20A, 20B, 20C and 20D. The tines are integrally formed with the base adjacent respective opposite edges and extend toward each other tine and project from the side of base 14 opposite the arms with the free ends of the tines spaced to form a retention passageway for receiving the wall 34 in response to the yieldable engagement of one of the tines with the wall during receipt or passage of the socket contact through the passageway 30 for enabling alignment of wall 34 with the retention passageway between the spaced free ends of the tines. The tail 18 is bent for receipt in the passageway formed through ridge 40 at one end of passageway 30 and communicating with passageway 30 to nest or recess the tail.

Pins 24 shown by way of example as extending from a plate 42 may be the leads from a solid state circuit package or of some other component. It is noted that because of the manner in which contacts 10 are mounted in socket 26, the right-hand pin enters from the top of the right-hand socket contact while the left-hand pin enters from the bottom of the left-hand socket contact. However, as previously indicated, because of the symmetrical design of the contacts, the pins may enter the socket contacts from either direction without any change in electrical characteristics.

While the invention has been shown and described above with reference to a preferred embodiment thereof, it would be apparent to one skilled in the art that various changes in form and details may be made therein without departing from the spirit and scope of the invention.

What is claimed is:

1. A socket contact for establishing four areas of physical support and electrical engagement with a metal pin contact having an axially elongate axis and movable in a direction coincident with said axis, the improvement comprising:

a metal base having two pair of free standing support portions, each support portion having a spring arm integrally formed thereon with each arm of said pair of arms having a cantilevered portion extending toward the cantilevered portion of the other arm; and a free and integrally formed on the extending end of each cantilevered portion with each free end extending in a direction away from the free end of the other arm of the respective pair of arms with the free ends and cantilevered portions of each pair of arms forming axially spaced aligned guideways for said pin contact to guide the receipt of said pin contact from either of two directions coincident with said axis and each pair of arms engaging said pin contact at a respective pair of positions spaced axially of said pin contact and providing two areas of physical support and electrical engagement with said pin contact for each pair of arms.

2. A socket contact combination comprising:

a socket contact for establishing four areas of physical support and electrical engagement with a metal pin contact having an axial elongated axis and movable in a direction coincident with said axis, the improvement comprising:

a sheet metal base having spaced elongated edges with opposite ends and lying in one general plane perpendicular to a second plane located intermediate said opposite ends;

a first pair of free standing support portions with each support portion formed integrally with said base at one end of a respective edge of said base with each support projecting transversely to said one general plane in a common direction and having a spring arm with a respective free cantilever portion transverse to said one general plane, each cantilever portion extending from the respective support portion at an angle to said second plane and toward the free cantilever portion of the other arm of said first pair of arms;

each cantilever portion having a free end extending from the respective cantilever portion in a direction away from the free end of the cantilever portion of the other arm of the first pair of arms and at an angle to said second plane with the free ends of said first pair of arms spaced adjacent said second plane, the cantilever portions and the free ends of said pair of arms spaced to form first yieldable guideways for receiving said pin contact in a respective direction coincident with the axis of said pin contact; and a second pair of free standing support portions with each support portion formed integrally with said base adjacent the other end of a respective edge of said base with each support portion of said second pair projecting transversely to said one general plane in said common direction and having a spring arm with a respective free cantilever portion transverse to said one general plane, each cantilever portion extending from a respective support portion at an angle to said second plane and toward the free cantilever portion of the other arm;

each cantilever portion of said second support portions having a free end extending from the respective cantilever portion of said second pair of arms in a direction away from the free end of the cantilever portion of the other arm of said second pair and at an angle to said second plane with the free ends being spaced adjacent said second plane, the cantilever portions and the free ends of said second pair of support portions spaced to form second yieldable guideways for receiving said pin contact in a respective direction coincident with the axis of said pin contact.

3. In the combination claimed in claim 2;

a housing having one passageway extending through said housing with said passageway having an elongate passageway axis for receiving said base and a second passageway transverse to said one passageway and communicating with said one passageway;

a wall formed on said housing and extending into said one passageway intermediate opposite ends of said one passageway with said wall having a pair of spaced surfaces transverse to said elongate passageway axis;

a pair of resilient generally planar cantilever tines integrally formed on said base with each tine projecting toward the other tine and having spaced ends to form a retention passageway with one of said tines yielding in one direction in response to engagement with said wall for enabling the alignment of said wall with said retention passageway and the engagement of the spaced ends of said tines with a respective said transverse surfaces for thereafter resisting retraction of said base from said passageway; and a tail formed on said base and received in said second passageway.

* * * * *